US006415944B1

(12) United States Patent
Toussant

(10) Patent No.: US 6,415,944 B1
(45) **Date of Patent: *Jul. 9, 2002**

(54) ARTICULABLE CONTAINER

(75) Inventor: John William Toussant, West Chester, OH (US)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/141,075

(22) Filed: Aug. 27, 1998

(51) Int. Cl.[7] ..... A47G 19/02

(52) U.S. Cl. ..... 220/574; 220/4.23; 220/4.24; 220/6; 229/146; 229/938

(58) Field of Search ..... 206/736, 735; 220/4.21, 4.22, 4.23, 4.24, 4.25, 574, 6, 839; 229/114, 904, 906, 120.08, 107, 146, 938

(56) References Cited

U.S. PATENT DOCUMENTS

| | | | | |
|---|---|---|---|---|
| 1,945,013 | A | | 1/1934 | Wilson |
| 2,073,498 | A | | 3/1937 | Seez |
| 2,170,040 | A | | 8/1939 | Stuart |
| 2,252,297 | A | | 8/1941 | MacIntyre |
| 2,468,306 | A | | 4/1949 | Norden |
| 3,033,434 | A | | 5/1962 | Carson |
| 3,511,433 | A | | 5/1970 | Andrews et al. |
| 3,596,822 | A | | 8/1971 | Holley |
| 3,771,713 | A | | 11/1973 | Davidson |
| 4,026,458 | A | | 5/1977 | Morris et al. |
| 4,266,713 | A | | 5/1981 | Maroszek |
| 4,441,626 | A | | 4/1984 | Hall |
| 4,606,496 | A | | 8/1986 | Marx et al. |
| 4,609,140 | A | | 9/1986 | Van Handel et al. |
| 4,706,606 | A | | 11/1987 | Coppola |
| 4,721,499 | A | | 1/1988 | Marx et al. |
| 4,721,500 | A | | 1/1988 | Van Handel et al. |
| 4,778,439 | A | | 10/1988 | Alexander |
| 4,804,137 | A | * | 2/1989 | Harby ..... 229/114 |
| 4,848,543 | A | | 7/1989 | Doboze |
| 4,890,576 | A | * | 1/1990 | James |
| 5,088,640 | A | | 2/1992 | Littlejohn |
| 5,110,038 | A | | 5/1992 | Pantisano et al. |
| 5,205,476 | A | | 4/1993 | Sorenson |
| 5,209,392 | A | | 5/1993 | Anatro |
| 5,230,939 | A | | 7/1993 | Baum |
| 5,279,456 | A | | 1/1994 | Bernstein |
| 5,326,020 | A | | 7/1994 | Cheshire et al. |
| 5,577,989 | A | | 11/1996 | Neary |
| 5,628,451 | A | | 5/1997 | Neary |

FOREIGN PATENT DOCUMENTS

| | | |
|---|---|---|
| GB | 2 302 533 | 1/1997 |
| WO | WO 93/23294 | 11/1993 |

* cited by examiner

*Primary Examiner*—David T. Fidei
(74) *Attorney, Agent, or Firm*—Larry L. Huston; Donald E. Hasse; E. Kelly Linman

(57) ABSTRACT

An articulable container. The container is articulable from and between a first open position to a second closed position. In the first open position the container can receive product. Additionally, the user may dispense or display product from the container while it is in the first open position. In the second closed position, the container covers or encloses the product. The closed position is useful for storing the product or transporting the product between two points such as the point of manufacture to the point of use or sale. The container may take the form of a plate, bowl, tray, clam shell, shipping container, display device, or other known configurations.

14 Claims, 4 Drawing Sheets

ARTICULABLE CONTAINER

FIELD OF THE INVENTION

This invention relates to containers, particularly a container which, in use, can assume two positions—a first position for receiving, displaying, or dispensing the contents of the container; and a second position for enclosing the contents of the container. The container may be disposable or reusable.

BACKGROUND OF THE INVENTION

Disposable containers are well known in the art. Disposable containers include common packages, shipping containers, cartons, paper plates, clam shells, bags, etc.

Many attempts have been made in the art to make more useful low cost containers. In particular, the art has paid considerable attention to disposable containers made of paperboard, plastic, and other low cost materials. Such containers are useful for various combinations of receiving, organizing, containing, transporting, storing, displaying, and dispensing products.

One such group of containers well known in the art is generally referred as folding cartons. A folding carton is typically made from a single blank which is cut and scored so as to have multiple hingedly connected panels. Upon folding, the panels form a tetrahedron shaped container, or a container having one of the other shapes known in the art. Exemplary art includes U.S. Pat. No. 4,289,268, issued Sep. 15, 1981 to Paige; U.S. Pat. No. 4,3755,258, issued Mar. 1, 1983 to Crayne et al., the disclosures of which are incorporated herein by reference; U.S. Pat. No. 4,448,308, issued May 15, 1984 to Carver U.S. Pat. No. 5,042,715, issued Aug. 27, 1991 to McNeill; U.S. Pat. No. 5,143,210, issued Sep. 1, 1992 to Warwick et al.; U.S. Pat. No. 5,275,331, issued Jan. 4, 1994 to Chung-Piao. However, all of these attempts in the art require intricate patterns, high tolerance cutting, and assembly with adhesives or other bonding means to be successful.

The art has also paid considerable attention to making, molding, and deforming containers out of a single plane, typically for food use. In this latter process a blank is provided. The blank may have radial grooves at its peripheral region. The blank is inserted between mating dies and pressed. The radial grooves provide for accumulation of the material deformed by the dies. Exemplary art includes U.S. Pat. No. 3,033,434, issued May 8, 1962 to Carson; U.S. Pat. No. 4,026,458, issued May 31, 1977 to Morris et al., the disclosures of which are incorporated herein by reference; U.S. Pat. No. 4,606,496, issued Aug. 19, 1986 to Marx et al.; U.S. Pat. No. 4,609,140, issued Sep. 2, 1986 to van Handel et al.; U.S. Pat. No. 4,721,500, issued Jan. 26, 1988 to van Handel et al.; U.S. Pat. No. 5,230,939, issued Jul. 27, 1993 to Baum; U.S. Pat. No. 5,326,020, issued Jul. 5, 1994 to Cheshire et al. However, none of these attempts in the art provide a way to use the articles described therein in a configuration other than that originally provided. Typically the articles, such as food containers, are provided in a generally open configuration with sloped side walls. The sloped side walls reduce the occurrences of food spilling from the food container.

Often the user would enjoy the convenience of a container which can be open to receive, display, or dispense products. At other times, the user would appreciate a container which can cover or otherwise enclose products. Covering or enclosing the product is useful in a variety of situations. Typically, these situations include the storage or transport of a product. One skilled in the art could imagine other uses and benefits. For example, when the container is used as a food container if the food is to be cooked (or even heated) in a microwave oven, covering, or preferably enclosing, the food reduces splattering and controls moisture loss. The user may wish to cover the food to keep it warm during the time between cooking and eating. The user may also wish to cover the food while transporting it, as may occur when food is prepared and/or served at a first location and eaten at a second location.

One attempt in the art to provide such conveniences is the clam shell. A clam shell is a container and lid hingedly connected together. The container and lid mating surfaces are preferably symmetric about the hinge line and may have a locking mechanism to hold the lid/container combination in the closed position. Clam shells are typically used in fast food restaurants for serving hamburgers, chicken nuggets, etc. However, the use of clam shells has drawbacks. For example, clam shells are typically small, approximating the size of a hamburger. If one wishes to have an entire plate of food, the clam shell would have to be sized to accommodate. This would require a food container and lid of equal size, so that the lid could cover the food. However, this arrangement represents wasted material. Typically one does not need or wish to cover the entire plate of food at once. For example, certain foods may later be added to the food container without heating. The full sized lid/container combination of the clam shell is unnecessary. Exemplary clam shells are shown in U.S. Pat. No. 4,778,439, issued Oct. 18, 1988 to Alexander; U.S. Pat. No. 5,205,476, issued Apr. 27, 1993 to Sorenson; and U.S. Pat. No. 5,577,989, issued Nov. 29, 1996 to Neary, the disclosures of which are incorporated herein by reference.

This invention provides a container which can be used in two different positions. The container can be used in a first open position for receiving, displaying, or dispensing product, and a second closed position for covering or enclosing the product. Finally, the container is stable in two different positions.

SUMMARY OF THE INVENTION

The invention comprises a container. The container is articulable about a plurality of multi-planar hinge lines. The hinge lines divide the container into an inboard spine and outboard wings. Preferably each wing is an isomere of the other, although, asymmetric containers are contemplated.

In another execution, the invention comprises a bi-stable container. The container is transformable between two positions, a first open position wherein the container can receive, display, or dispense product and a second closed position wherein the container covers or encloses the product. The container has a central region and a circumjacent peripheral region. The peripheral region is preferably raised relative to the central region when the container is in an open position.

DETAILED DESCRIPTION OF THE INVENTION

Figure 1:
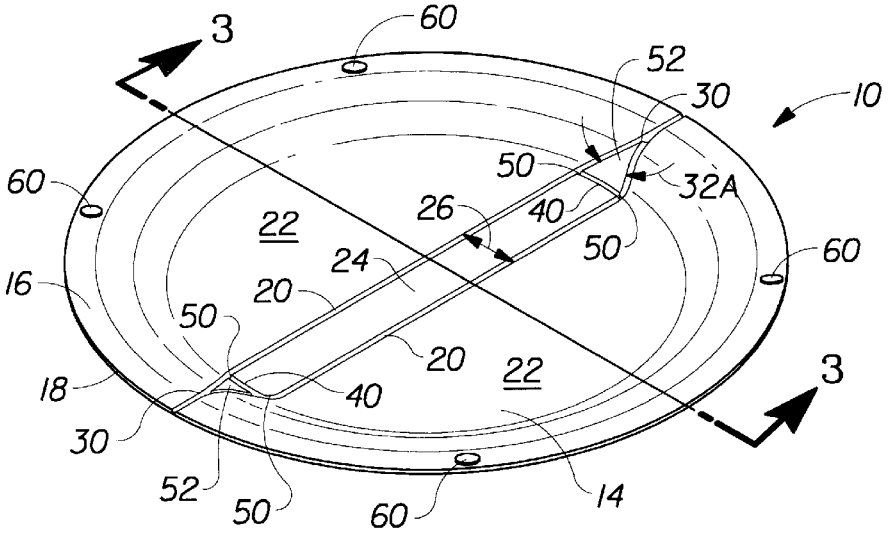
FIG. 1 is a perspective view of a container according to the present invention, the container being in an open position.
Figure 3:
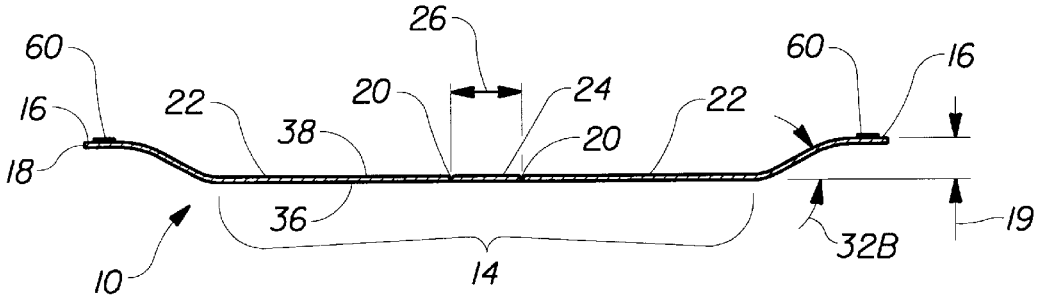
FIG. 3 is an instantaneous vertical sectional view taken along lines 3—3 of FIG. 1 and showing the fastening devices behind the cutting plane.
Figure 2:
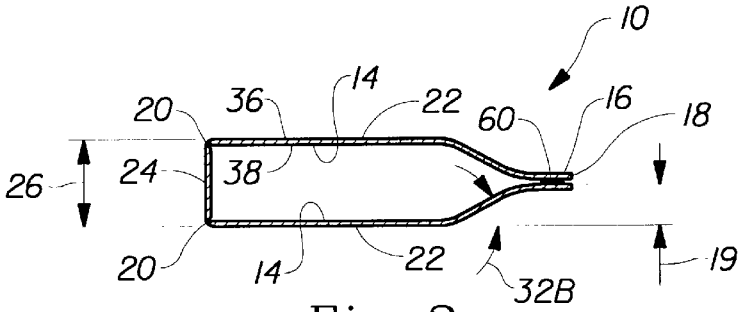
FIG. 2 is an instantaneous vertical section view of the container of FIG. 1 in a closed position.

Referring to FIGS. 1–3, the container 10 according to the present invention may comprise a relatively shallow container such as a plate, a bowl, a tray, a cosmetic case, a dispenser for medication, a clam shell, or any other configuration or use known in the art.

The container 10 is articulable between a first open position and a second closed position. In the first open position the central region 14 of the container 10 according to the present invention may be macroscopically monoplanar and accessible for product to be deposited thereon. In the second closed position, the container 10 has a smaller footprint, and covers or even encloses the product. The first and second positions are defined by structural features of the container 10. The first and second positions do not occur randomly or by accident as for example, may occur when a container such as a paper plate according to the prior art is crumpled for disposal.

Figure 4:
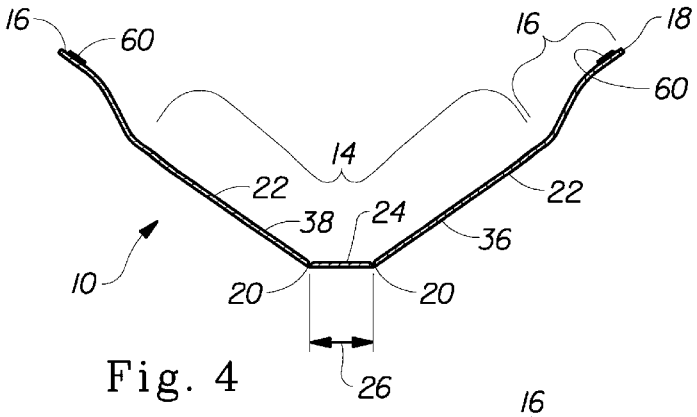
FIG. 4 is an instantaneous vertical sectional view of the container of FIGS. 1–3 shown in an intermediate position, between the open and closed positions.

The container 10 according to the present invention is considered to be bistable. By "bistable" it is meant that the container 10 can indefinitely remain in either the first or second position. The container 10 does not move from the first position to the second, from the second position to the first or from either position to an intermediate position without external influence. Nor does the container 10 assume other positions or configurations as illustrated in FIG. 4 without external influence. Furthermore, the container 10 enjoys unexpected rigidity while in the first position.

Examining the container 10 of FIGS. 1–3 in more detail, the container 10 comprises a central region 14 and a circumjacent peripheral region 16. The central region 14 and peripheral region 16 are disposed in two different planes. The central region 14 defines the X-Y plane of the container 10. The Z-direction of the container 10 lies perpendicular to the X-Y plane. Of course, one of ordinary skill will recognize the container 10 will necessarily contain a transition region from the central region 14 to the peripheral region 16. In normal use, the peripheral region 16 is typically raised relative to the central region 14. The peripheral region 16 is joined thereto at a non-perpendicular angle.

Figure 13:
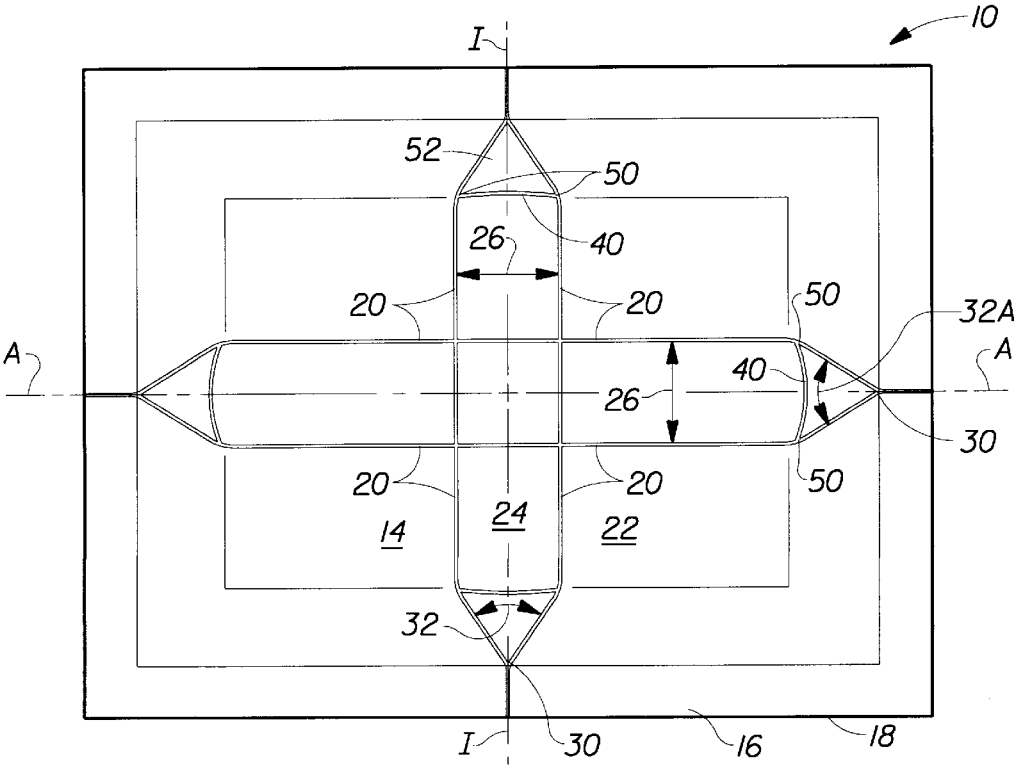
FIG. 13 is a top plan view of a rectangular container according to the present invention.

The boundary and shape of the peripheral region 16 are defined by the edge 18 of the container 10. It is to be recognized that the dimensions and relative proportions of the peripheral region 16 and central region 14 of the container 10 will vary according to the exact size and intended use of the container 10. While a round container 10 is illustrated in FIG. 1, one of ordinary skill will recognize that any suitable shape and depth of container 10 may be selected for use with the present invention and the invention is not so limited. Other suitable shapes include squares, rectangles, ovals, various polygons, etc. A rectangular container 10 according to present invention is illustrated in FIG. 13.

Figure 5:
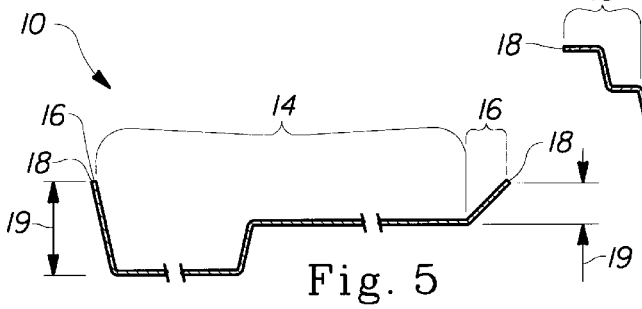
FIGS. 5–6 are instantaneous vertical sectional views of asymmetric embodiments of two containers suitable for use with the present invention, the cutting plane having been taken generally parallel to the spinal hinge lines, the embodiment of FIG. 5 having a central region with two different depths and a peripheral region of negligible radial width and the embodiment of FIG. 6 having an upstanding partition therein.

It is not necessary that either the central region 14 or the peripheral region 16 be flat, parallel to the X-Y plane, or generally planar. One of ordinary skill will recognize that, for example, bowls having a generally concave shaped bottom will be suitable for use with the present invention. It is only necessary that the central region 14 and the peripheral region 16 be spaced apart in the Z-direction. The Z-direction distance from the bottom surface of the central region 14 (taken while the container 10 is in an open, generally horizontal position) to the top surface of the peripheral region 16 is referred to as the Z-direction depth 19 of the container 10. If there are different Z-direction depths 19 at different portions of the container 10, the Z-direction depth 19 is taken at the vertices 50, discussed below, of the spinal hinge lines 20. It is to be recognized that different vertices 50 may define different Z-direction depths 19. FIG. 5 illustrates a container having dual Z-direction depths 19.

Referring back to FIG. 3, the container 10 according to present invention is divided by a plurality of, and preferably two, hinge lines 20. A preferred configuration has spaced apart first and second hinge lines 20, referred to as spinal hinge lines 20.

The spinal hinge lines 20 divide the container 10 into two wings 22, and a spine 24 disposed between the wings 22. The wings 22 are outboard of the spine 24. Ordinarily each wing 22 is an isomere of the other. However, it is to be recognized that asymmetrical configurations may be desirable and are within the scope of the claimed invention as shown in FIGS. 5–10.

The spinal hinge lines 20 allow the wings 22 to be articulated about either spinal hinge line 20. Preferably the articulation is reversible and more preferably sustainable for a number of cycles, so that the container 10 may be opened and closed a number of times.

Both portions of the container 10, i.e., the wings 22 and the spine 24, may be articulated about the spinal hinge line 20. Of course, the articulation is in a direction generally perpendicular to the spinal hinge lines 20.

Preferably the spinal hinge lines 20 are generally parallel and symmetrical with one another. However, it is to be recognized that the spinal hinge lines 20 may be slightly concave towards each other or slightly convex away form each other or a combination thereof. If a clam shell is selected for the container 10, the spinal hinge lines 20 should be generally perpendicular to the hinge of the clam shell.

Referring back to FIGS. 1 and 2 and examining the spine 24 in more detail, the spine 24 has a width 26, taken generally perpendicular to the principal direction of the spinal hinge lines 20. If the spinal hinge lines 20 are not straight, the width 26 of the spine 24 is taken directly perpendicular to the spinal hinge lines 20 at the point(s) where the spinal hinge lines 20 intercept the peripheral region 16. The width 26 of the spine 24 is measured along this perpendicular, from the centerline of the first spinal hinge line 20 to the centerline of the second spinal hinge line 20 along the outer surfaces of the container 10 while it is in the closed position of FIG. 2.

The width 26 of the spine 24 is important to providing the bistable characteristics of the container 10. Preferably, the width 26 of the spine 24 is approximately two times the Z-dimension depth 19 from the central region 14 to the peripheral region 16, taken at the vertices 50 described above. By proportioning the width 26 of the spine 24 to be approximately two times the Z-dimension depth 19, the container 10 can remain in the closed position without undue stress or being unstable. The spine width 26 will be tapered if the Z-direction depth 19 varies between the diametrically opposed vertices 50.

Figure 7:
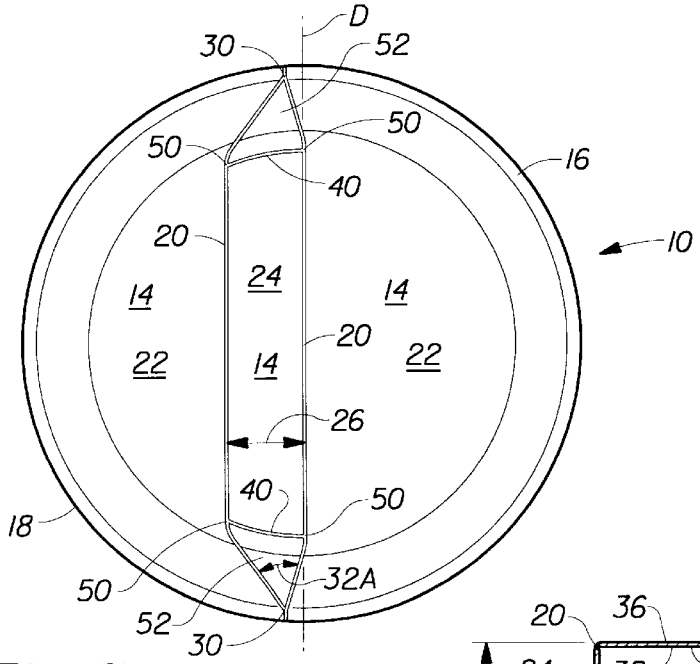
FIG. 7 is a top plan view of a container according to the present invention, the container being in an open position and having the spine offset relative to a diameter of the container.
Figure 8:
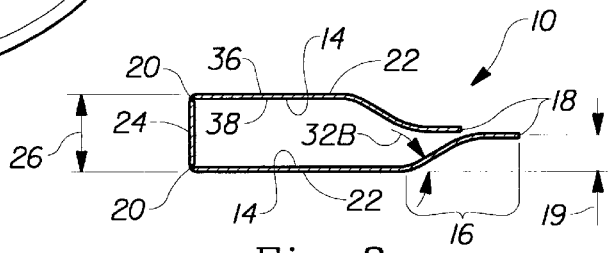
FIG. 8 is a vertical sectional view of the container of FIG. 7 in a closed position.

Referring to FIGS. 7–8, it is not necessary that the spine 24 be centered on the container 10 or centered on a diameter D of a round container 10. For example, the spine 24 may be offset relative to the diameter D of a round container. Such configurations are feasible and within the scope of the claimed invention. This arrangement allows for partial covering of the contents of the container. This embodiment may be useful where increased venting or contact between the contents and the atmosphere is desired.

Figure 9:
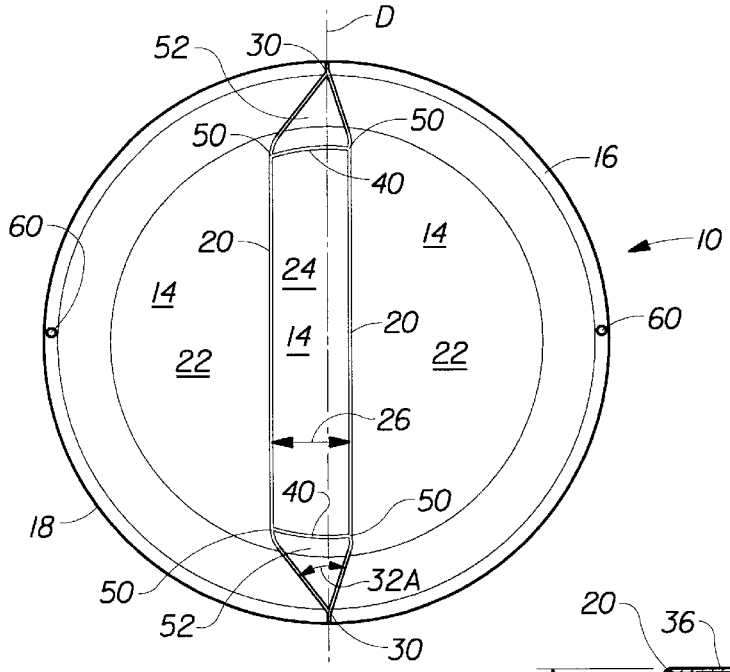
FIG. 9 is a top plan view of a container according to the present invention, the container being in an open position and having the common points centered on a diameter of the container but the spine width offset relative to the diameter.
Figure 10:
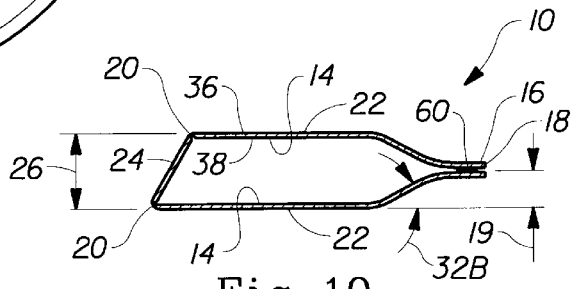
FIG. 10 is a vertical sectional view of the container of FIG. 9 in a closed position.

Referring to FIGS. 9–10, the common points 30 of the spine 24 may also be centered on a diameter D, with the spinal hinges line 20 unequally spaced, in the width direction, from this diameter. In this configuration, the common points 30 are diametrically opposed, unlike the embodiments of FIGS. 7–8 where the common points 30 lie on a chord. In the embodiment of FIGS. 9–10, the wings 22 will not be isomeres of one another. Instead, one wing 22 will be shorter, in the width direction, than the other wing 22. However, it is to be recognized as illustrated in FIG. 10 that when the container 10 is articulated to the closed position, the spine 24 will not be perpendicular to the wings 22. Instead, the spine 24 will be disposed in a non-perpendicular relationship relative to the wings 22.

Referring to FIGS. 1, 7, and 9, as the spinal hinge lines 20 approach the peripheral region 16 of the container 10, the spinal hinge lines 20 may converge towards one another. Upon convergence, the spinal hinge lines 20 intercept each other at a common point 30 juxtaposed with the peripheral region 16 of the container 10. Preferably the common point 30 is coincident the highest Z-direction elevation of the peripheral region 16.

Figure 12A:
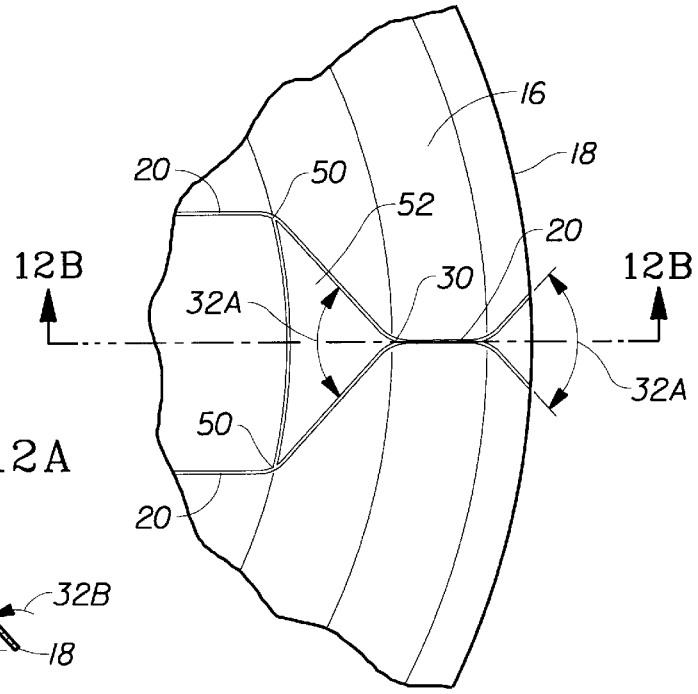
FIGS. 12A and 12B are fragmentary schematic representations of a top plan view and a vertical sectional view, respectively, showing the correspondence and instantaneous angles between the transition region and peripheral region of a container as it deviates in the Z-direction from the horizontal in FIG. 12B and the spinal hinge lines as they converge and diverge in FIG. 12A.
Figure 12B:
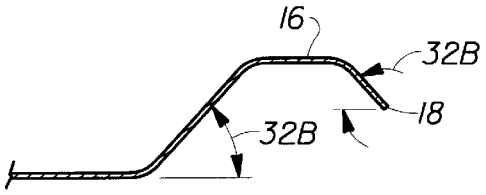

Referring to FIGS. 12A and 12B, the hinge lines 20 may converge towards this common point 30 at a predetermined azithmuthal angle 32A. The instantaneous azithmuthal angle 32A measured as the included angle between the spinal hinge lines 20, is nominally equivalent to two times the instantaneous angle 32B taken in the Z-direction, at which the peripheral region 16 of the container 10 rises from the central region 14 of the container 10.

Referring to FIGS. 1, 7, 9, 11, and 12A the spinal hinge lines 20 may be provided by any means well known in the art. Preferably, the spinal hinge lines 20 comprise lines of weakness, reducing the bending force across that hinge line 20 and allowing the container 10 to fold in a predetermined manner. The spinal hinge lines 20 may be disposed on the tension side 36 or the compression side 38 of the container 10. Suitable spinal hinge lines 20 include score lines, and perforations if the intended use does not involve liquids. Material can be cut or removed from the container 10 to form the spinal hinge lines 20. Preferably, however, material is compressed or densified to form the spinal hinge lines 20. Scoring design and techniques are well known in the art. If the container 10 is made of plastic, the spinal hinge lines 20 are preferably living hinges as are also well known in the art.

The spinal hinge lines 20 according to the present invention are considered to the multi-planar. By "multi-planar" it is meant that the spinal hinge lines 20 traverse a single direction, and extend, at least for a discernible distance, in a direction having a vector component perpendicular to the first direction.

Preferably, the point at which the spinal hinge lines 20 deviate from the first direction is coincident a topographical or structural feature of the container 10. As illustrated in the figures the spinal hinge lines 20 generally deviate from planarity at the points where the spinal hinge lines 20 intercept the peripheral region 16 of the container 10.

At these points, one or more connector hinge lines 40 having a principal direction generally perpendicular to the spinal hinge lines 20 may be provided. Preferably two such connector hinge lines 40 are provided and are diametrically opposite the center of the container 10, as illustrated in FIG. 1. The connector hinge lines 40 may be juxtaposed with and approximate the inwardly disposed portion of the peripheral region 16 of the container 10. Preferably, the connector hinge lines 40 are congruent thereto and therefore, may subtend an arc equivalent to the width 26 of the spine 24.

The connector hinge lines 40 intercept the spinal hinge lines 20 at two vertices 50. The vertices 50 are disposed on the radially outermost portion of the central region 14, and coincident the Z-direction elevation of the central region 14. The two vertices 50 and their respective common point 30 (where the spinal hinge lines 20 intercept one another) form a generally triangular panel 52. Without being bound by theory, it is believed the triangular panel 52 may inflect from a concave inward position to a concave outward position and assist the container 10 in remaining in the first and second positions. However it has been found that the existence of material in the triangular panels 52 is not critical to the claimed invention, although its absence will allow leakage.

The container 10 according to the present invention may be made of a rigid material, particularly a material which provides for inflection of triangular panel 52, as noted above. Suitable rigid materials include foam, plastic, and various other synthetic materials. The container 10 may be made of cellulose and, if so, may be made of solid bleached sulfite or layers of various types of fibers including recycled cellulose. If desired, additional rigidity and thermal insulating capability may be provided by the materials selected for the container 10. For example, the container 10 may be made of metal or corrugated board.

Corrugated board comprises a generally flat layer, and a corrugated layer. The corrugated layer is not joined at all positions to the flat layer, but instead has ribs which are spaced apart from the flat layer and troughs joined to the flat layer. The ribs and troughs are often straight and parallel, but may be sinusoidal. In cross section, a rib may be S-shaped, C-shaped, Z-shaped, or have any other configuration known in the art. Furthermore, if desired, a second flat panel may be joined to the corrugated medium and disposed opposite the first flat panel.

The container 10 may be molded from a pulp slurry or pressed from a blank between mating shaped platens. Both methods of manufacture are well known in the art.

If desired one or more fastening devices 60 may be added to the container 10 to assist in maintaining the container 10 in the closed second position. Fastening devices 60 are well known in the art. For the embodiment described herein, having a generally round shape two fastening devices 60 may be provided on the container 10. The fastening devices 60 may be disposed at positions subtending an included angle of 60° or greater. For the embodiments described herein, a 90° included angle allows the fastening devices 60 to be positioned midway between the common points 30 and the point on the edge 18 of the container 10 furthest from the spine 24 when the container 10 is in the closed position.

Suitable fastening devices 60 include those having two complementary portions which are peripherally spaced apart, and preferably oppositely disposed. One portion is disposed on each isomere of the container 10. Suitable fastening devices 60 include buckles, latches, pressure sensitive adhesive, selectively activatable adhesive, hook and loop fasteners, tab and slot fasteners, cohesive fasteners, and other fasteners known in the art. Selectively activatable adhesive may be used if one wishes to completely seal the container 10 according to the present invention for relatively long term product storage. The fastening devices 60 may be made generally in accordance with commonly assigned U.S. Pat. No. 4,979,613 issued Dec. 25, 1990 to McLaughlin et al.; U.S. Pat. No. 5,1116,563 issued May 26, 1992 to Thomas et al.; U.S. Pat. No. 5,230,851 issued Jul. 27, 1993 to Thomas; or U.S. Pat. No. 5,662,758 issued Sep. 2, 1997 to Hamilton et al., the disclosures of which are incorporated herein by reference. If desired embossed and deformable mating snap fasteners wherein one wing of the container 10 locks or mechanically latches into the other wing of the container 10 may be utilized.

Figure 6:
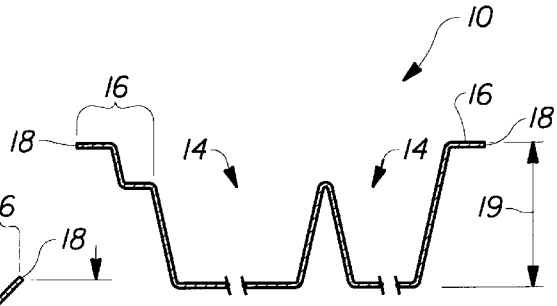

While disposable containers 10 have been described above, it is to be recognized that durable and reusable containers are within the scope of the claimed invention as well. Additionally, the materials from which the container 10 are made need not be the same throughout. For example, the spine 24 of the container 10 may be made of a heavier material than the wings 22. Also, one wing 22 may be longer, heavier or differently shaped than the other wing 22 if, for example, it is desired to have the second wing 22 serve primarily as a lid for the first wing 22. Also, the wings 22 need not be isomeres of each other. Asymmetrical configurations (as taken both parallel and perpendicular to the spine 24) as illustrated in FIGS. 5–10, are within the scope of the claimed invention as well. Additionally, the container 10 may comprise an upstanding partition, as illustrated in FIG. 6, to provide separate compartments within the container 10. The upstanding partition may intercept the spinal hinge lines 20.

The container 10 may be executed in a variety of configurations and geometries. However, one of ordinary skill will recognize there are practical limits to the possible geometries. For example for a round container, as the radius of the central region 14 approaches the Z-direction depth 19 of the container 10, the volume of the container 10 will be limited when it is in the closed position.

Furthermore, the peripheral region 16 of each wing 22 of the container 10 need not be in registry with the peripheral region 16 of the other wing 22 when the container 10 is in the closed position. Although such embodiments are illustrated one of ordinary skill will recognize that a container 10 having the peripheries 16 of the wings 22 offset from one another in the closed position may also be desirable as illustrated in FIG. 8. Such a configuration allows for venting of the container in its closed position and of the product therein.

Figure 11:
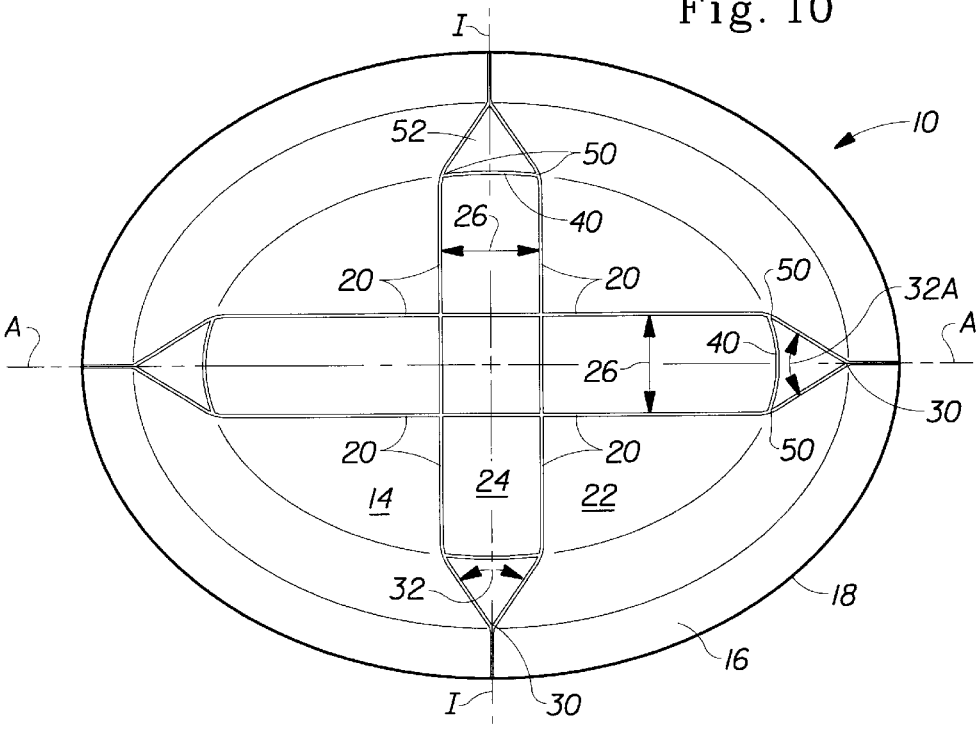
FIG. 11 is a top plan view of a container having different major and minor axis, and being articulable about both axes.

Referring to FIG. 11, the container 10 of the present invention is suitable for use with elliptical and other non-aximmetrically shaped containers 10. For example, the container may have unequal major and minor axes A, I. In such a configuration, a spine 24 and spinal hinge lines 20 may be provided in the two mutually perpendicular directions coincident the major and minor axes A, I. Of course, one will recognize that a spine 24 and spinal hinge lines 20 may be provided in a direction intermediate the major axis A and minor axis I of the container 10.

The embodiment of FIG. 11 provides the advantage that, depending upon the direction selected for articulation from the open position to the closed position, the container 10 may have different aspect ratios in the closed position. Thus, contents or products of different shapes may be readily accommodated by the container 10. Also, any container 10 shape with more than one axis about which the container 10 is symmetric, could have multiple spines 24. This may be particularly useful when, like the ellipse, the different orientations of the spine 24 result in different shapes when the container 10 is in the closed position. For example, an open square container 10 articulated parallel to two sides results in a rectangular container 10 in the closed position. When the same square container 10 is articulated about its diagonal axis, the resulting container 10 is triangular in the closed position. Also, a round container 10 may also be provided with plural spines 24 and associated spiral hinge lines 20.

While various shapes of and materials for containers 10 have been showed and described, it is to be recognized that various sizes of containers 10 are contemplated for the present invention as well. For example, the container 10 may be small enough to fit in one's purse or pocket. Such a container 10 is useful for carrying personal items such as medication, beauty care implements and products used for hygiene or personal cleansing.

Alternatively, the container 10 may be sized to fit on a flat bed trailer and transported by a semi-truck. Such a container 10 may be used to transport construction materials, machinery, tools, etc. while keeping them dry and clean during transport. Containers 10 smaller than, larger than and intermediate the sizes of those just described are contemplated and suitable as well.

Additionally, features may be added to the container 10 to accommodate the size, particular product or contents of the container 10, and its ultimate intended use. For example, the container 10 may be provided with handles (not shown) to assist in portability or carrying heavy contents. The handles may be attached to the wings 22, spine 24, or both. The handles may be appended to the outside of the container 10 or cut out from the wings 22. Additionally, casters may be added to the spine 24 so that the container may be utilized as, for example, luggage to carry clothing, etc. while the user is away from home.

Additionally, the inside of the container 10 may be provided with features to accommodate the desired end use. For example, the inside of the container 10 may be provided with various compartments to hold a plethora of small and differently shaped products or contents. Alternatively, the inside of the wings 22 may be provided with hooks or other attachments to hold a plethora of small products or contents. Such an arrangement may be useful when the container 10 is to be later used as a display case to show the products once the final destination is reached. Many other combinations and variations are feasible and within the scope of the appended claims.

What is claimed is:

1. A container, said container having a central region and a peripheral region circumscribing said central region and extending outwardly therefrom said peripheral region terminating in an edge defining the boundary of said container, said container defining a first plane, said container being articulable about first and second spaced apart multi-planar hinge lines, said multi-planar hinge lines lying in said first plane and extending in a first direction lying within said first plane said multi-planar hinge lines further extending a discernible distance in a second direction having a vector component perpendicular to said first direction and perpendicular to said first plane, said first and second hinge lines converging towards said edge at two spaced apart points.

2. A container according to claim 1 wherein said hinge lines divide said container into isomeric sections.

3. A container according to claim 1 wherein said hinge lines comprise first and second generally parallel hinge lines traversing said container and being spaced apart from one another.

4. A container according to claim 3 wherein said container is rectangularly shaped.

5. A container according to claim 3 having two pluralities of multi-planar hinge lines, said two pluralities being azimuthally offset from one another.

6. A container according to claim 3 wherein said plurality of hinge lines comprise first and second spaced apart hinge lines and further comprising two connector hinge lines, said two connector hinge lines joining said first and second spaced apart hinge lines.

7. A container according to claim 6 wherein said connector hinge lines are generally perpendicular to said first and second hinge lines.

8. A container according to claim 3 wherein at least a portion of said first and said second hinge lines are generally parallel.

9. A container according to claim 1 wherein said hinge lines comprise lines of weakness in said container.

10. A container according to claim 3 further comprising an upstanding partition.

11. A container according to claim 10 wherein said partition intercepts at least one of said hinge lines.

12. A container according to claim 1 wherein said container is articulable between a first open position and a second closed position, said container further comprising a closure, said closure maintaining said container in said second closed position when used therefor.

13. A container according to claim 1 wherein said container comprises cellulose.

14. A container according to claim 1 wherein said hinge lines also diverge at spaced apart points juxtaposed with said edge.

* * * * *